US005991949A

United States Patent [19]

Miller, Sr. et al.

[11] Patent Number: 5,991,949

[45] Date of Patent: Nov. 30, 1999

[54] HOSELESS AIR BED

[75] Inventors: Craig S. Miller, Sr., Yorba Linda; Craig S. Miller, Jr., Corona, both of Calif.

[73] Assignee: Foamex L.P., Linwood, Pa.

[21] Appl. No.: 08/890,173

[22] Filed: Jul. 9, 1997

Related U.S. Application Data

[63] Continuation of application No. 08/515,158, Aug. 15, 1995, abandoned.

[51] Int. Cl.[6] ..... A47C 27/10

[52] U.S. Cl. ..... 5/710; 5/713

[58] Field of Search ..... 5/706, 710, 713, 5/726, 738

[56] References Cited

U.S. PATENT DOCUMENTS

| | | | |
|---|---|---|---|
| 1,772,310 | 8/1930 | Hart | 5/456 |
| 2,777,490 | 1/1957 | Mark | 383/66 |
| 2,998,817 | 9/1961 | Armstrong | 5/469 |
| 3,042,941 | 7/1962 | Marcus | 5/708 |
| 3,192,540 | 7/1965 | Swank | 5/456 |
| 3,653,083 | 4/1972 | Lapidus | 5/709 |
| 4,624,877 | 11/1986 | Lea et al. | 5/449 |
| 4,722,105 | 2/1988 | Douglas | 5/453 |
| 4,821,354 | 4/1989 | Little | 5/706 |
| 4,838,309 | 6/1989 | Goodwin | 5/456 |
| 4,944,060 | 7/1990 | Peery et al. | 5/713 |
| 4,995,124 | 2/1991 | Wridge, Jr. et al. | 5/713 |
| 5,022,109 | 6/1991 | Pekar | 5/449 |
| 5,144,708 | 9/1992 | Pekar | 5/655.3 |
| 5,373,595 | 12/1994 | Johnson et al. | 5/470 |
| 5,634,225 | 6/1997 | Miller, Sr. et al. | 5/710 |
| 5,745,941 | 5/1998 | Miller, Sr. | 5/710 |

FOREIGN PATENT DOCUMENTS

| | | | |
|---|---|---|---|
| 2141333 | 12/1984 | United Kingdom | 5/455 |

*Primary Examiner*—Michael F. Trettel
*Assistant Examiner*—Robert G. Santos
*Attorney, Agent, or Firm*—Natan Epstein; Beehler & Pavitt

[57] ABSTRACT

An inflatable mattress for clinical bed use has a base pad including two sheets joined to define one or more narrow air conduits extending along the pad. A body supporting surface is provided by individually detachable inflatable elements covering the base pad. Each inflatable element is secured across the pad transversely to and communicates with at least one air conduit through apertured fasteners. Air permeable foam in the air conduits holds the conduits open in a gatched condition of the pad. Cushioning material contained between the sheets exteriorly to the air conduits provides body support in the event of deflation of the mattress. Constant pressure and alternating pressure modes of operation are supported with appropriate air supply systems.

13 Claims, 5 Drawing Sheets

22
28
28
10
28
20
26
18
14
24
16
12

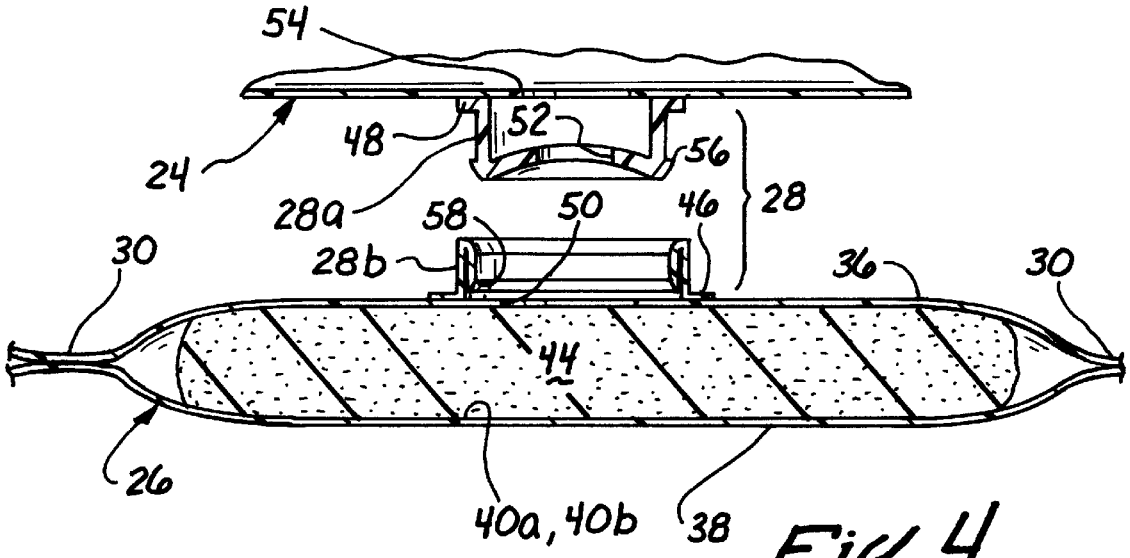
Fig. 4
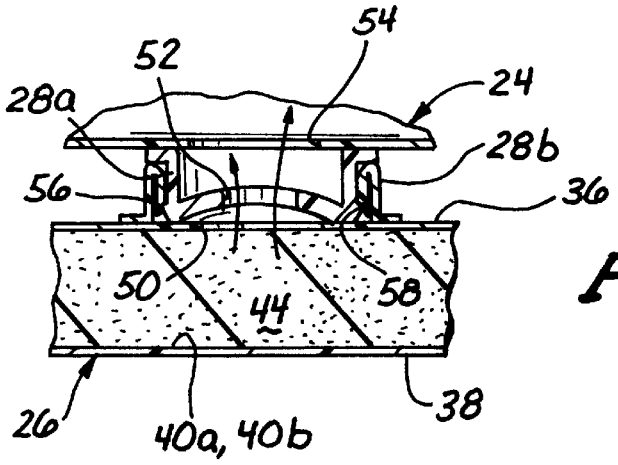
Fig. 4A
Fig. 5
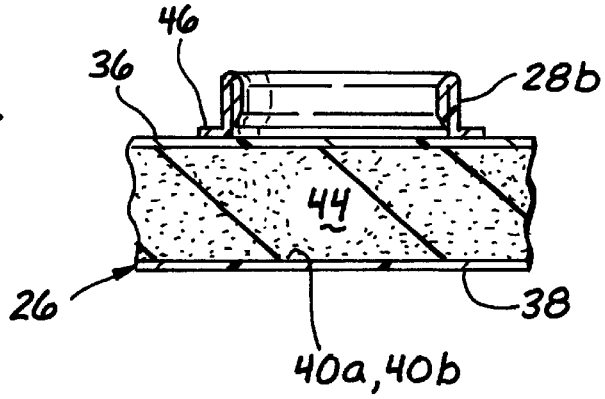

HOSELESS AIR BED

This application is a continuation of application Ser. No. 08/515,158 filed on Aug. 15, 1995 abandoned.

BACKGROUND OF THE INVENTION

1. Field of the Invention

This invention pertains generally to the field of inflatable mattresses and more particularly is directed to an air support bed of modular construction in which air distribution conduits supplying multiple inflatable chambers are integrated into a common base pad to dispense with external air hoses.

2. State of the Prior Art

Air support beds are in widespread use in medical care settings, particularly for patients requiring long term bed care. Bed ridden patients are susceptible to skin ulcerations caused by excessive buildup of heat and moisture on the skin, typically in combination with pressure, friction and shear forces exerted on the skin by contact with the bed surface, which tend to close off capillary blood circulation in skin tissues. Such ulcerations are painful and slow to heal, and are a frequent complication in bed ridden individuals. Air mattresses and air support beds have been found to alleviate this problem because the air filled chambers of the bed tend to conform to the anatomy of the bed ridden patient better than ordinary mattresses and consequently distribute pressure over a wider area of skin, thereby diminishing the risk and severity of skin ulcerations. Furthermore, the firmness of an air mattress can be controlled and adjusted simply by increasing or diminishing the internal air pressure, and air support beds featuring positive pressure regulation by means of electronically controlled air pumps have been developed. Air mattresses with compartmentalized air chambers which can be individually pressurized to different degrees are used for creating different zones of varying firmness adapted to the requirements of different anatomical areas of the patient's anatomy.

The requirements of long term medical bed care has led to the development of four principal classes of air beds.

Static pressure air beds are kept inflated to a preset pressure by an air blower or air pump.

Computerized or positive pressure control air beds feature one or more air pressure sensors connected to an electronic control system which actuates an air pump and an air relief valve, supplying or venting compressed air as needed to hold the internal pressure of the air chambers of the bed at a preset level, compensating as the user shift positions or gets in and out of the bed.

Cyclic pressure air beds alternately inflate and deflate different air chambers of the bed mattress so as to periodically shift pressure between different areas of the user's anatomy. The cyclic action of the air bed tends to stimulate the affected tissues and provides an opportunity for blood circulation to re-establish itself in those areas.

Low loss air beds have air chambers with finely perforated walls which allow pressurized air to leak continuously from the air chambers at a controlled rate into the bed cavity containing the air support unit. The continuous airflow under the patient carries away excess moisture and prevents heat buildup, which as earlier mentioned are among the principal causes of skin tissue breakdown in bed ridden patients.

Each of these categories of air beds has its particular advantages, and one type may be preferred over the others depending on a combination of medical benefit and economic considerations.

Existing air beds of these different types make use of external conduits, typically plastic hoses, connected in a manifold arrangement for distributing pressurized air from a common source, such as an electric air pump, to each of the inflatable elements of the air bed. The external air hoses usually include a main conduit connected at one end to the air pump and running the length of the air mattress along one side, with branch tubes feeding each inflatable element of the mattress. This air hose manifold is a relatively costly and complex component of the air bed. It is awkward to handle and detracts from the visual appearance of the air bed, and is normally tucked away out of sight between the air matress and the bed frame.

What is needed is a multichamber air bed with an integral air distribution system which eliminates the need for the external air hose manifold. The improved air bed should be of reduced complexity and cost competitive with conventional air beds.

SUMMARY OF THE INVENTION

The aforementioned need is addressed by the present invention which provides a hoseless inflatable air mattress for use in medical and non-medical air beds. The novel air mattress has a base pad, a number of inflatable elements, fasteners for releasably attaching the inflatable elements to the base pad, and air conduits associated with the base pad, the fasteners being adapted to place each of the inflatable elements in fluidic communication with the air conduits such that the fasteners serve both to retain the inflatable elements to a common base pad and also as connectors for supplying and venting compressed air to and from the inflatable elements thereby to dispense with the need for external air tubing connected to the inflatable elements. It is preferred that the air conduits according to this invention be integral with and interior to the base pad. For example, the base pad can include a number of sheets of impermeable material containing therebetween a cushioning material, the sheets being selectively joined to each other to define the air conduits. An air permeable resilient spacer, such as an open cell synthetic foam and preferably a reticulated synthetic foam material, may be provided between the sheets within the air conduits to ensure open passage for air flow. The sheets of the base pad may be of a weldable pliable material such as a radio frequency weldable thermoplastic, and the selective joining may be by continuous air-tight weld joints between the sheets to define the air conduits in the base pad.

The fasteners may each include first and second fastener elements secured respectively to the base pad and the inflatable elements, the first and second fastener elements being configured to make interlocking mechanical engagement for releasably securing the inflatable elements to the base pad, the fastener elements defining in such interlocking engagement an opening admitting passage of air between at least one of the air conduits in the base pad and each of the inflatable elements. The first and second fastener elements may be welded, as by radio frequency welding or other equivalent method, to the base pad and the inflatable elements respectively.

Each air conduit in the base pad may be defined between two parallel joint lines extending the length of the base pad and each inflatable element may be attached to the base pad by at least two fasteners. For example, a rectangular base pad may have two parallel air conduits and the fasteners may be arranged in a row overlying each air conduit. Each inflatable element may be in the form of an air tube retained to the base pad by a pair of the fasteners, one fastener on each air conduit.

In one form of the invention, both fasteners of each inflatable element are in fluidic communication with a corresponding one of the air conduits and both of the air conduits are connected to a common source of compressed air. In another form of the invention, mutually adjacent inflatable elements are fluidically connected by respective fasteners to separate air conduits defined in the base pad, and the separate air conduits are connected to a separate supply of compressed air such that an alternating pressure mattress is provided. In particular, each inflatable element may be attached to the base pad by two fasteners, each fastener mounted on one of the two separate air conduits, but only one of the fasteners being in fluidic communication with the corresponding air conduit, adjacent inflatable elements being in fluidic communication with different ones of the air conduits.

The inflatable elements may be tubular and arranged in adjacent mutually parallel relationship on the base pad, the fasteners being arranged in two or more parallel rows on the base pad, each of the inflatable elements being attached to the based pad by at least one of the fasteners in each row, the fasteners being adapted to place each inflatable element in fluidic communication with air conduits of the base pad. In an alternating pressure version of the mattress, the fasteners in only one of the rows are open to passage of air between a corresponding air conduit and each inflatable element, the open fasteners alternating between the rows for successively adjacent inflatable elements, and each row of fasteners is connected by corresponding air conduits to a separate supply of compressed air.

These and other advantages, features and improvement of the present invention will be better understood by reference to the following detailed description of the preferred embodiment taken in conjunction with the accompanying drawings.

BRIEF DESCRIPTION OF THE DRAWINGS

FIG. 4 is a detailed sectional view taken along line 4—4 in FIG. 3 showing in exploded relationship a male fastener element on an air tube of the mattress and a female fastener element mounted in fluidic communication with an air conduit of the base pad;

FIG. 4*a* shows the male and female fasteners elements of FIG. 4 in engaged interlocked relationship for securing the air tube to the base pad and establishing air flow between the air tube and an underlying air conduit in the base pad;

FIG. 5 shows a closed female fastener element on the base pad serving to attach an air tube to the base pad without establishing fluidic communication with an underlying air conduit in the base pad.

DETAILED DESCRIPTION OF THE PREFERRED EMBODIMENTS

Figure 1:
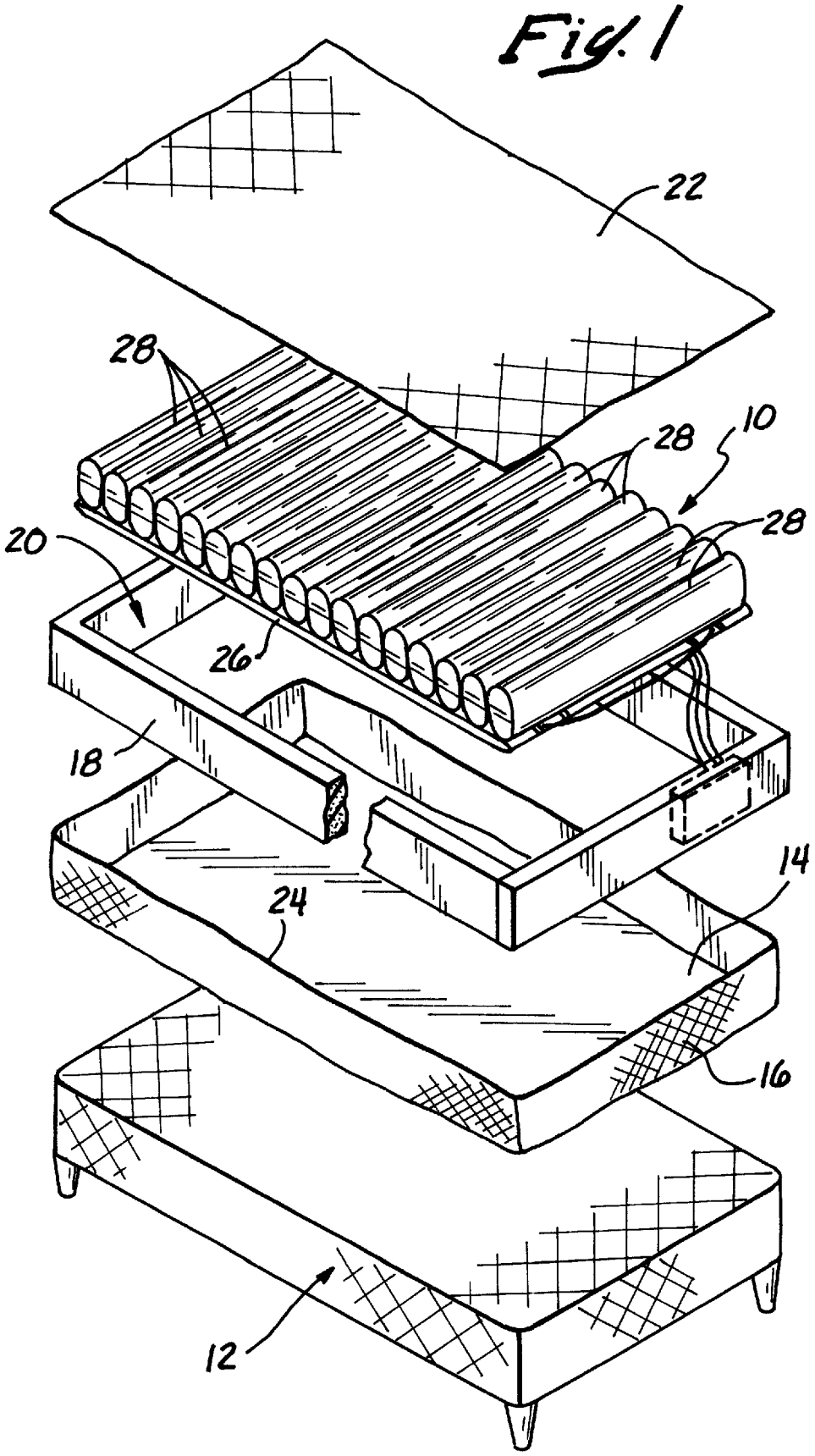
FIG. 1 is an exploded perspective view of a typical bed incorporating an inflatable mattress according to this invention.
Figure 2:
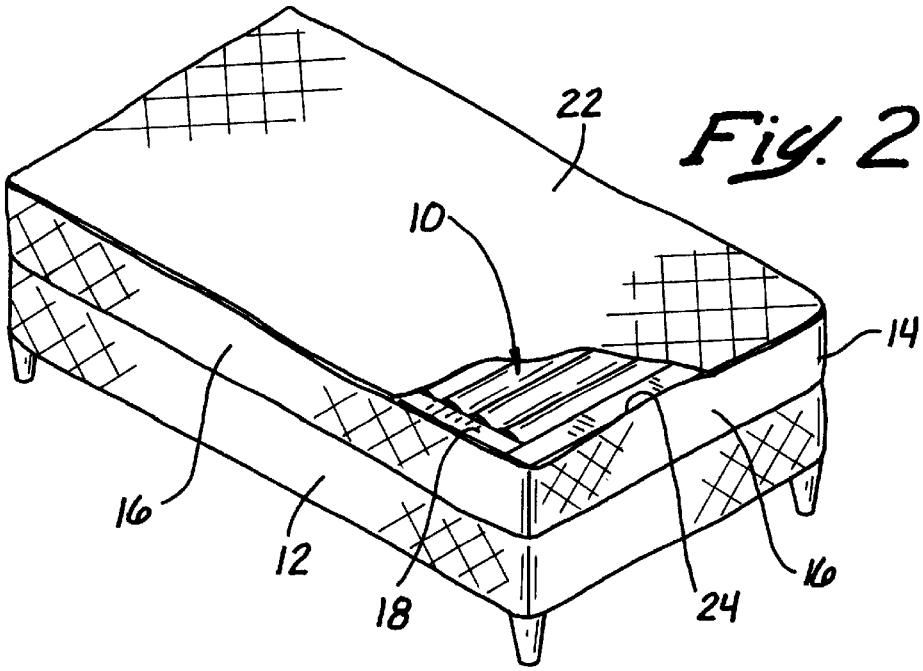
FIG. 2 is a perspective view of the bed of FIG. 1 in assembled relationship, with the bed cover broken away to show the inflatable mattress contained in the bed frame.

With reference to the accompanying drawings, FIG. 1 shows a typical bed assembly featuring an air mattress 10 according to this invention. The bed includes a suitable base 12 adapted to elevate the mattress 10 above a ground surface, a coverlet including a coverlet bottom 14 which includes a side wall 16, and a rectangular inner frame 18 of synthetic foam dimensioned to fit in the coverlet bottom 14 against the side wall 16 and defining a rectangular cavity 20 which receives the inflatable mattress 10. A coverlet top 22 completes the assembly and attaches to the coverlet bottom along the upper perimeter 24 of the side wall 16, as by means of a zipper type fastener to enclose, contain and support the frame and mattress, as shown in FIG. 2.

Figure 1A:
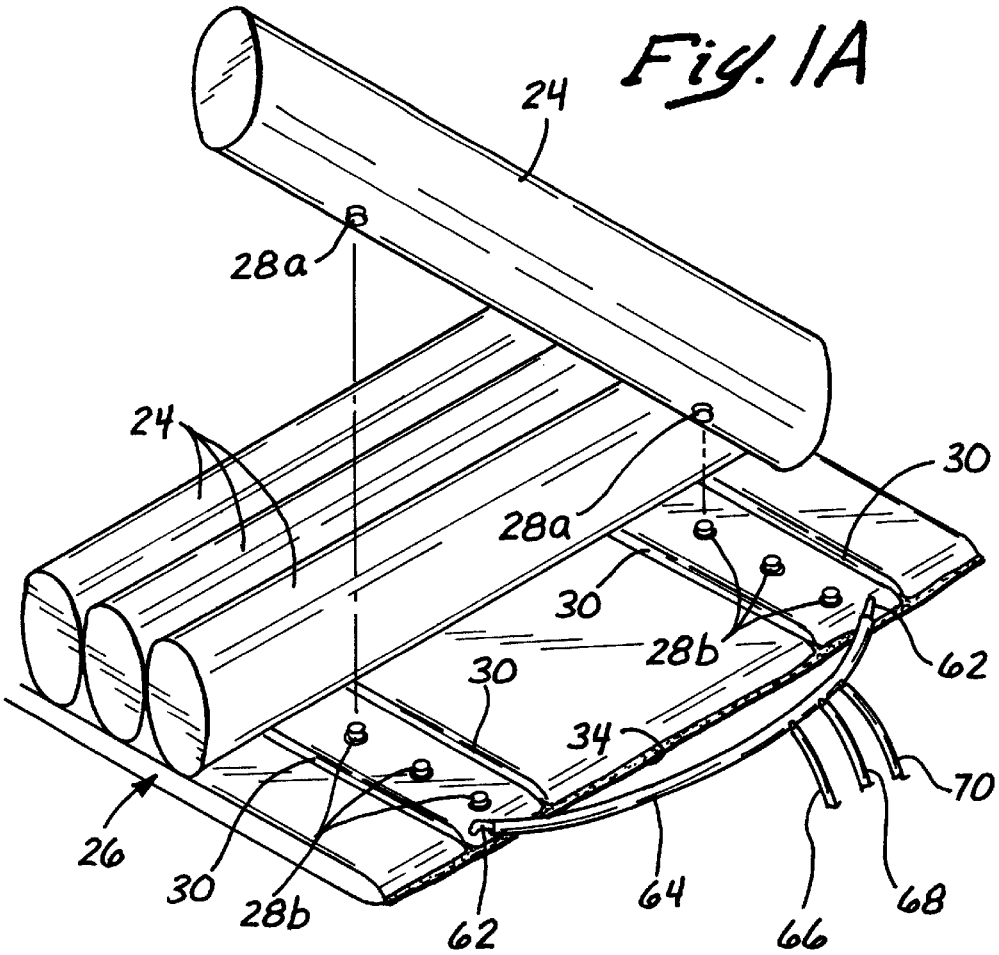
FIG. 1*a* is a fragmentary perspective view of the inflatable mattress of this invention, illustrating the attachment of the inflatable elements to the base pad.
Figure 1B:
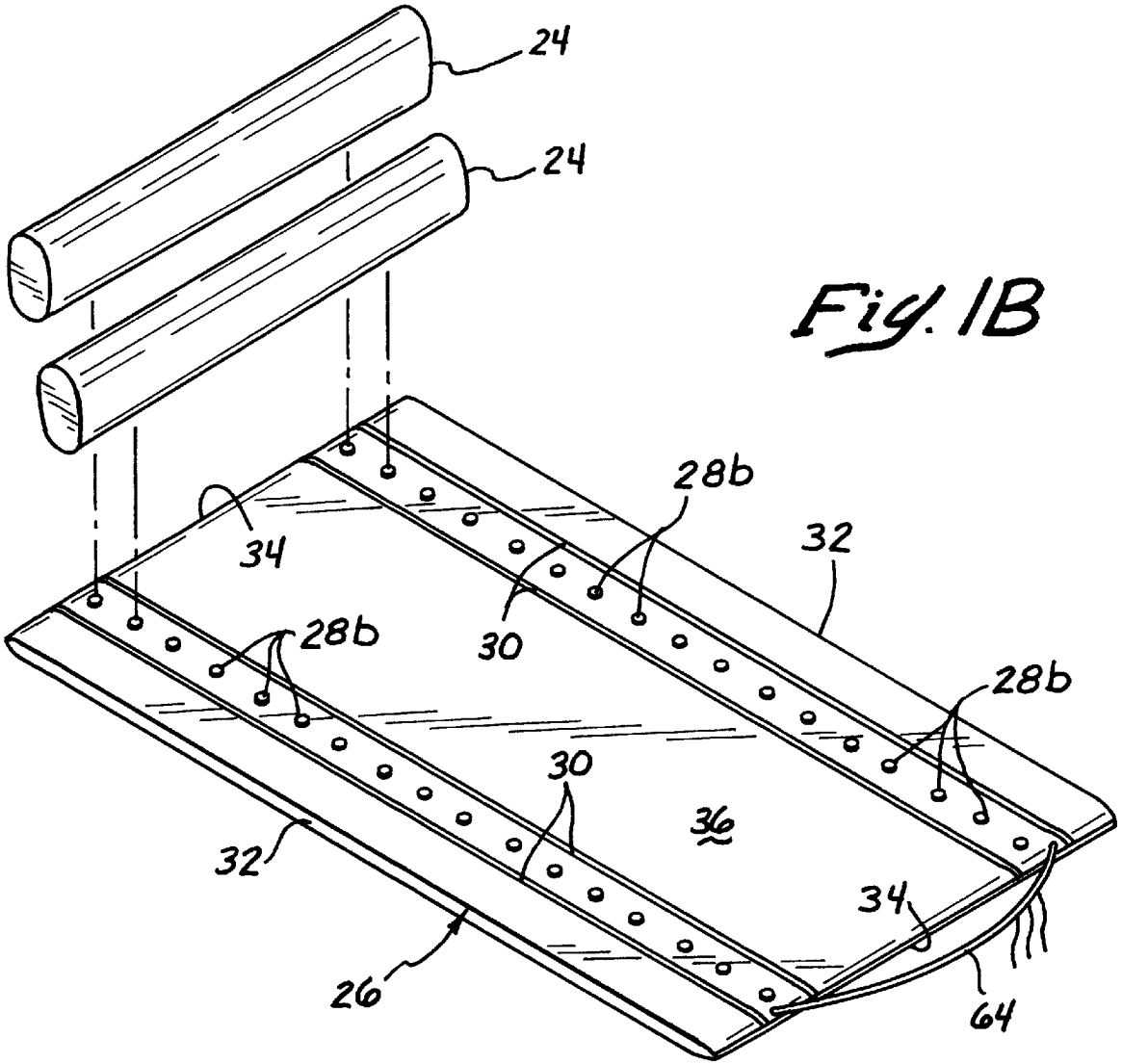
FIG. 1*b* is a perspective view of the base pad of this invention showing the fasteners arranged in two rows, along corresponding air conduits integral to the base, with two inflatable elements shown in exploded relationship to the base pad.

As best seen in FIG. 1B the inflatable mattress 10 has an array of inflatable air tubes 24 mounted in closely adjacent mutually parallel relationship to a common base pad 26. Each air tube 24 has a generally ellipsoid cross section, preferably with a somewhat flattened top, bottom and side surfaces, i.e., generally as a rectangle with rounded corners. Each air tube 24 is made of relatively thin pliable impermeable radio frequency weldable plastic sheet material, such as 20 gauge vinyl or urethane plastic sheeting. A single rectangular sheet of such material can be formed into a tube by joining along two opposite edges, and the initially open opposite ends of the tube then capped with end pieces shaped according to the desired cross section of the finished air tube.

Figure 3B:
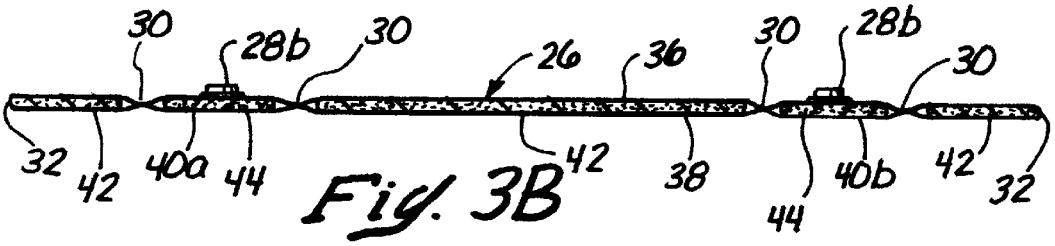
FIG. 3*b* is a sectional view of the base pad taken along line 3*b*—3*b* in FIG. 3.

As best seen in FIG. 1B the base pad 26 is a rectangular pad having sides 32 extending between opposite ends 34, and as shown in the cross section of FIG. 3B the base pad has an upper sheet 36 and a lower sheet 38 which are joined along the sides 32 and the ends 34. The two sheets 36, 38 are of 20 gauge vinyl material and are also continuously joined to each other along straight parallel weld lines 30 which extend the full length of the pad between the opposite ends 34. The weld lines 30 are arranged in pairs which define between them two air conduits 40*a* and 40*b* interior to and integral with the base pad. Padding or cushioning material such as a thickness of suitable compressible synthetic foam 42 is contained between the sheets 36, 38 in the areas of the base pad exterior to the air conduits 40*a* and 40*b*. The two air conduits also contain a thickness of resilient material 44 but one which is permeable to the flow of air, such as an open cell synthetic foam such as urethane foam and preferably a reticulated synthetic foam, and which keeps the upper and lower sheet 36, 38 spaced apart from each other along the length of the air conduits to ensure free flow of air along the entire length of each air conduit even with a moderate load bearing upon the base pad, for example the weight of a person supported in normal usage of the air mattress 10 or if the base pad is bent, as when gatching a hospital bed.

As shown in FIG. 1A, each air tube 24 is removably fastened to the base pad 26 by means of two fasteners 28 spaced apart along the longitudinal dimension of the tube. Each fastener 28 includes a male and a female fastener element 28*a*, 28*b* respectively, as illustrated in FIGS. 4 and 4*a*. The male element is permanently secured to the air tube 24, while the female element of the fastener is permanently attached to the base pad 26. The fastener elements 28*b* are evenly spaced in two rows between the opposite ends 34 of the base pad, each row aligned with and directly overlying one of the air conduits 40*a*, 40*b*. Each air tube 24 has a pair of male fastener elements 28*a* mounted to its underside and spaced apart from each other so as to match the spacing between a corresponding pair of female fastener elements 28*b*, one in each of the two rows on the base pad.

The fasteners 28, best seen in FIGS. 4 and 4A, are commercially available items known as "valves" in the air bed industry. For example, a suitable product sold as "Roberts Valves" and marked with U.S. Pat. No. 2,777,490 is available from Halkey-Roberts Corp., 11600 9th Street North, St. Petersburg, Fla. 33716. As commercially sold, these valves include both a male and a female portion which are linked together by a flexible connection or hinge portion, the entire article being formed as an integral unit by injection molding of a pliable thermoplastic material. The conventional use of these valves has been in the manufacture of inflatable elements of various sizes and shapes used in air beds and mattresses. Conventionally, the female portion of the valve is mounted onto an exterior surface of the inflatable element and is centered around an opening to the inflatable element. This opening can then be sealed by pressing the male portion of the valve into mating engagement with the female portion. Such a valve allows the inflatable element: to be rapidly emptied of air by opening the valve and flattening the inflatable element. The valve is also essential in the manufacture of the inflatable element because it allows insertion of a backing tool required for making the air-tight joints, such as lap joints, between the various pieces of sheet material constituting the inflatable element. The female portion includes an annular wall with a radial mounting flange extending from the bottom side of the annulus. The male portion is a cap which makes an air-tight fit into the top side of the female portion. An annular expandable seal in the female portion cooperates with a radial lip on the male portion to make the air-tight seal. The valve is normally mounted to the inflatable element of an air mattress by bonding the mounting flange on the female element bottom to the outer surface of the inflatable element. This bonding may be by means of a suitable adhesive or by a welding process such as radio frequency welding of the thermoplastic material. These valves are commercially available in two configurations: in one the female element has an open center, while in the other a flap in the female element operates as a one way valve which opens if pressed on one side, i.e. towards the interior of the inflatable element of the air bed, but is normally held closed by air pressure in the inflatable element. For purposes of the present invention, the valves with an open female portion are preferable. For this purpose, the male and female portions of the valve are separated from each other by cutting away the hinge or linkage between them in the commercial article to obtain the male and female fastener elements 28*a*, 28*b* illustrated in the drawings. Additionally, an opening 52 as in FIGS. 4 and 4*a* is made in the male element.

Figure 3:
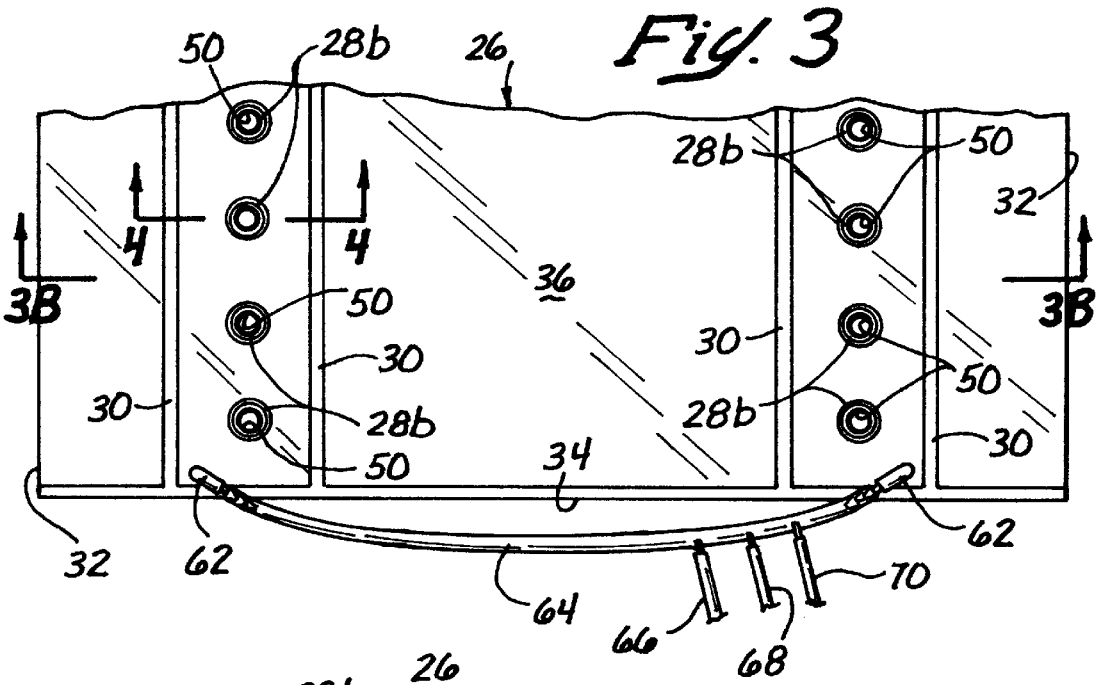
FIG. 3 is a fragmentary top plan view of the base pad showing a common air supply connection to the two air conduits of the base pad.

As shown in FIG. 3, a series of holes 50 are made in the sheets 36 of the base pad in a row centered over each air conduit 40*a*, 40*b*. A female fastener element 28*b* is centered around each of these openings 50. The female element 28*b* is secured to the upper sheet 36 by welding the mounting flange 46 of the female element 28*b* to the outer surface of the upper sheet 36 of the base pad, as shown in FIGS. 4, 4A and 5. Each male element 28*a*is similarly secured to the bottom of an air tube 24 over an opening 54 in the sheet material of the air tube 24, as by welding its radial flange 48 to the sheet material of the inflatable tube.

Each air tube 24 is attached to the base pad 26 transversely to the air conduits 40*a,b* by pressing the two male fastener elements 28*a* of the tube into corresponding female fastener elements 28*b* as shown in FIG. 4*a*. The radial shoulder 56 on the male fastener element makes air-tight sealing engagement with a seal flange 58 in the female fastener element, to make both a mechanically retentive engagement and also an air-tight seal between the two fastener elements. The two fastener elements can, however, be readily separated if so desired by simply applying sufficient pulling force between the two fastener elements. Each of the air tubes 24 can therefore be readily separated and removed from the base pad 26 should replacement of the tube ever become necessary.

Turning now to FIG. 3, elbow connector tubes 62 have one end inserted through the upper sheet 36 and into each of the air conduits 40*a*, 40*b*. The outer ends of the elbow connectors 62 are fitted to and interconnected by an air distribution hose 64. Three smaller diameter hoses are in turn connected to the distribution hose 64, including an air supply hose 66, an air exhaust hose 68 and a pressure sensor hose 70. These three hoses are connected to a regulated supply of compressed air, not shown in the drawings and which may be of conventional design, which supplies compressed air through hose 66, has an exhaust valve connected to hose 68 and has a pressure sensor connected to hose 70. The pressure sensor derives a feedback signal input to a control system which responds to the pressure sensor signal so as to actuate an air pump and deliver compressed air to hose 66 if the sensed pressure falls below a preset level, or actuates the vent valve to bleed air from the air mattress 10 through hose 68 if the mattress pressure exceeds the desired level.

Compressed air supplied to, or exhausted from, the air distribution hose 64, flows to and from all of the air tubes 24 through all of the fasteners 28 of the air mattress 10. Furthermore, all of the air tubes 24 are in fluidic communication with each other through each of the air conduits 40*a* and 40*b*. Consequently, air pressure is distributed evenly throughout the body support surface defined by the upward facing surfaces of the air tubes 24. This type of air mattress is also known as a constant pressure mattress because its internal air pressure is held to a preset value and is approximately uniform over the mattress surface.

Figure 3A:
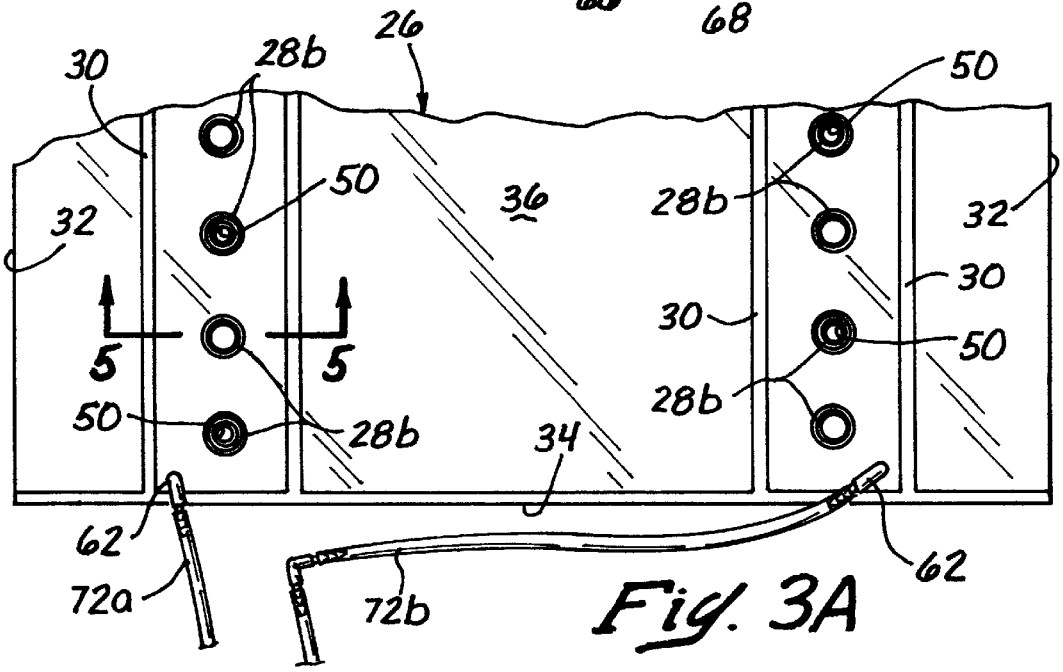
FIG. 3*a* is a view as in FIG. 3 showing separate air supply connections to the two air conduits and with open and closed fasteners alternating along the two air conduits for an alternating pressure mattress.

FIG. 3A shows a variant of the present invention in the form of an alternating pressure air mattress. This is accomplished by connecting each air conduit 40*a* and 40*b* to a separate air hose 72*a*, 72*b*, respectively, each of which is in turn provided with an air supply, air exhaust and pressure sensing hose connections (not shown in the drawings) analogous to hoses 66, 68 and 70 in FIG. 3. The female fastener elements 28*b* are arranged in a row along each of the two air conduits 40*a* and 40*b* as explained in connection with FIGS. 1–3. However, only every other one of the female fasteners elements 28*b* in each row communicates with its corresponding air conduit 40*a*, 40*b*, by means of an opening 50 in the sheet 36. The fluidically closed female fastener elements 28*b* are arranged as shown in FIG. 5. The fastener elements 28*b* are the same in all cases, except that the closed fasteners are mounted on a portion of the sheet 36 which lacks any opening into the underlying air conduit so that no air flows through the fastener element 28*b* to an air tube 24 attached to that fastener element. The mechanical function of the fastener element 28*b* in FIG. 5 is unchanged from that explained in connection with FIGS. 4 and 4A. Each air tube 24 attaches by means of its male fastener elements 28*a* to one open female fastener element 28*b* and one closed female fastener element 28*b*. The open and closed female fasteners for each successive air tube 24 between the opposite ends 34 on the base pad alternate between the two air conduits 40*a*, 40*b* . Thus, in the first left and right pair of female fasteners elements 28*b* in FIG. 3A adjacent to the bottom end 34 of the base pad, the left hand fastener element 28*b* has an opening 50 into the air conduit 40*a*, while the right hand fastener element 28*b* is closed to the other air conduit 40*b* . This condition is reversed for the next pair of fastener elements 28*b* where the left hand fastener element is closed to the air conduit 40*a*, while the right hand fastener element 28*b* is open to the air conduit 40*b* by a hole 50. This pattern of communication between the air conduits and the female fastener elements repeats itself along the entire length of the base pad. When compressed air is supplied to one of the air hoses 72*a*, 72*b*, compressed air is consequently fed only to every other one of the air tubes 24 along the base pad. By alternately feeding compressed air to the two air tubes 72*a*, 72*b*, while concurrently venting air from the other of the two air tubes, a cyclic action is obtained by which alternate air tubes are inflated and deflated, an action which is beneficial to the well-being of a person supported on such a mattress.

From the foregoing, it will be appreciated that a considerable simplification has been achieved by eliminating exterior air hoses and air conduits, resulting in increased reliability, ease of handling and maintenance of the air mattress, all without sacrifice in performance.

While particular embodiments of the invention have been described and illustrated for purposes of clarity and example, it must be understood that many changes, substitutions and modifications to the described embodiments will be apparent to those possessed of ordinary skill in the art without thereby departing from the scope and spirit of the present invention which is defined by the following claims.

What is claimed is:

1. An inflatable mattress comprising:

a base pad, a plurality of generally tubular inflatable elements together defining a body support, fastener means for releaseably attaching a bottom of each of said inflatable elements to one side of said base pad, said base pad having two sheets of pliable impermeable material joined to each other for containing therebetween a compressible resilient cushioning material of substantial thickness, said two sheets being also selectively joined to each other along pairs of joint lines to define air conduits relatively narrow in relation to a width of said base pad and extending transversely to and underneath said inflatable elements between each of said fastener means and one or more fluid inlets provided on said pad, said cushioning material extending generally the width and length of said base pad between said sheets outside said air conduits, and air permeable resilient spacer means between said sheets in said one or more air conduits, said fastener means adapted to place each of said inflatable elements in fluidic communication with said conduits, such that said base pad may be bent as when gatching a bed on which is disposed the base pad without thereby closing airflow through said air conduits, and said cushioning material provides substantial resilient support to the body of a patient lying on said base pad even with loss of air pressure in said inflatable elements.

2. The mattress of claim 1 wherein said resilient spacer means is an open cell synthetic foam material.

3. The mattress of claim 1 wherein said sheets are of a radio frequency weldable pliable material and are selectively joined by continuous air-tight weld lines to define said conduits.

4. The mattress of claim 1 wherein said fastener means are adapted for releasably securing said inflatable elements to said base pad.

5. The mattress of claim 4 wherein said fastener means include first and second fastener elements secured respectively to said base pad and said inflatable elements, said first and second fastener elements being configured to make interlocking engagement for releasably securing said inflatable elements to said base pad, said fastener elements defining in said interlocking engagement an opening between said conduits and each of said inflatable elements.

6. The mattress of claim 1 wherein said fastener means are valve elements of flexible plastic material attached to each of said base pad and said inflatable elements.

7. The mattress of claim 1 wherein said resilient spacer means is a reticulated synthetic foam material.

8. The mattress of claim 1 wherein said sheets, said inflatable elements and said fastener means are made of radio-frequency weldable material, said selective joining comprises welds between said sheets, and said fastener means comprise first and second fastener elements welded to said one of said sheets and said inflatable elements respectively.

9. The mattress of claim 1 further comprising connector means on said base pad for connecting said air conduits to a supply of compressed air.

10. The mattress of claim 1 wherein each of said inflatable elements is attached to said base pad by at least two of said fastener means.

11. The mattress of claim 1 wherein said air conduits comprise at least two air conduits extending in straight mutually parallel lines across said base pad, and each of said inflatable elements is fluidically connected by said fastener means to each of said air conduits.

12. The mattress of claim 11 wherein all said fastener means are connected by said air conduits to a common supply of compressed air.

13. The mattress of claim 11 wherein said fastener means in each of said rows is connected by said air conduits to a separate supply of compressed air, the fastener means in only one of said rows being open to passage of air between a corresponding one of said air conduits and each of said inflatable elements, the open fastener means alternating between said rows for successively adjacent ones of said inflatable elements, such that an alternating pressure mattress is provided.

* * * * *